US005584402A

United States Patent [19]

Johnson

[11] Patent Number: 5,584,402

[45] Date of Patent: Dec. 17, 1996

[54] BAG STORAGE AND DISPENSING RACK

[75] Inventor: Lawrence Johnson, Ponte Vedra Beach, Fla.

[73] Assignee: Vanguard Plastics, Inc., Addison, Tex.

[21] Appl. No.: 538,424

[22] Filed: Oct. 2, 1995

[51] Int. Cl.[6] ..... A47F 7/00

[52] U.S. Cl. ..... 211/50; 211/12; 211/181; 248/95; 206/554

[58] Field of Search ..... 211/12, 50, 57.1, 211/59.1, 181; 248/95, 97; 206/554

[56] References Cited

U.S. PATENT DOCUMENTS

| | | | |
|---|---|---|---|
| 2,899,161 | 8/1959 | Bayard | 248/101 |
| 3,380,579 | 4/1968 | Pinto | 206/57 |
| 3,552,697 | 1/1971 | Pinto | 248/97 |
| 3,640,450 | 2/1972 | Lieberman | 229/53 |
| 3,646,723 | 3/1972 | Meroney | 53/390 |
| 3,747,298 | 7/1973 | Lieberman | 53/390 |
| 4,062,170 | 12/1977 | Orem | 53/390 |
| 4,085,822 | 4/1978 | Osborn | 186/1 A |
| 4,165,832 | 8/1979 | Kuklies . | |
| 4,199,122 | 4/1980 | Christie | 248/97 |
| 4,458,867 | 7/1984 | Malik | 248/97 |
| 4,487,388 | 12/1984 | Provan | 248/97 |
| 4,676,378 | 6/1987 | Baxley et al. | 206/554 |
| 4,819,898 | 4/1989 | Benoit et al. | 248/97 |
| 4,819,899 | 4/1989 | Well | 248/97 |
| 4,821,985 | 4/1989 | Dematteis et al. | 248/97 |
| 4,840,335 | 6/1989 | Forman, Jr. et al. | 248/97 |
| 4,840,336 | 6/1989 | Stroh et al. | 248/97 |
| 4,981,216 | 1/1991 | Wilfong et al. | 206/554 |
| 4,995,860 | 2/1991 | Wilfong, Jr. | 493/195 |
| 5,020,750 | 6/1991 | Vrooman et al. | 249/97 |
| 5,060,809 | 10/1991 | Bayes et al. | 211/12 X |
| 5,074,674 | 12/1991 | Kuklies | 383/8 |
| 5,092,548 | 3/1992 | Bayes et al. | 248/95 X |
| 5,205,435 | 4/1993 | Daniels | 221/44 |
| 5,269,416 | 12/1993 | DeMatteis | 211/50 |

*Primary Examiner*—Robert W. Gibson, Jr.
*Attorney, Agent, or Firm*—Ross, Clapp, Korn & Montgomery, L.L.P.

[57] ABSTRACT

A rack for storing and dispensing a supply of bags incudes a base member. The base member includes a track extending between first and second ends of the base member. The rack has first and second ends and is adapted for supporting a supply of bags. The rack includes structure for engaging the track of the base member. The rack is slidable on the base member between a bag loading position in which the rack first end is disposed adjacent to the base member second end, and a bag storing and dispensing position in which the rack first end is disposed adjacent to the base member first end.

17 Claims, 5 Drawing Sheets

BAG STORAGE AND DISPENSING RACK

TECHNICAL FIELD OF THE INVENTION

The present invention relates to a bag storage and dispensing rack, and more particularly to under counter mounted rack.

BACKGROUND OF THE INVENTION

Various types of rack and racking systems have been utilized for storing, dispensing, and loading of bags. Typically, a stationary or portable rack is used at a cashier or store clerk check-out station at which bags are readily available for loading by store personnel. Several types of bags are utilized such as, for example, "T-shirt" style grocery sacks as well as merchandise bags.

Where counter space is limited, existing racks interfere with the merchandise check-out procedure since items of merchandize must be piled on top of one another in order to fit on a countertop. Therefore, racks may be mounted at a location inconvenient to store clerks or cashiers, such that bags are not readily available for loading.

A need has thus arisen for an improved bag storage and dispensing rack for storing and dispensing bags at a convenient location to cashier and store clerk personnel where counter space is limited.

SUMMARY OF THE INVENTION

In accordance with the present invention, a rack for storing and dispensing a supply of bags is provided. The rack includes a base member. The base member includes a track extending between first and second ends of the base member. The rack has first and second ends and is adapted for supporting a supply of bags. The rack includes structure for engaging the track of the base member. The rack is slidable on the base member between a bag loading position in which the rack first end is disposed adjacent to the base member second end, and a bag storing and dispensing position in which the rack first end is disposed adjacent to the base member first end.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
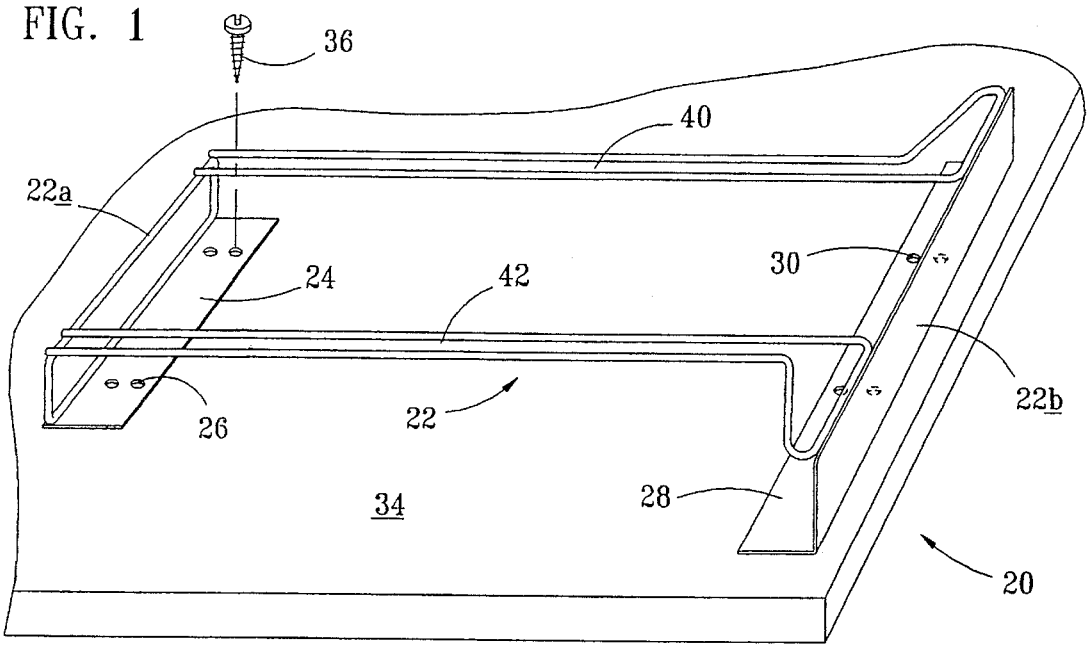
FIG. 1 is a perspective view of the base member for use with the present rack.

Referring simultaneously to FIGS. 1–4A, the present rack for storing and dispensing a supply of bags is illustrated, and is generally identified by the numeral 20. Rack 20 includes base member, generally identified by the numeral 22. Base member 22 includes ends 22*a* and 22*b*. End 22*a* includes a bracket 24 having apertures 26. End 22*b* of base member 22 includes a bracket 28 having apertures 30. Base member 22 is adapted to be mounted to a horizontal surface, such as, for example, a shelf 34 which is located under a cashier or store clerk check-out counter (not shown). Brackets 24 and 28 may be mounted to shelf 34 via fasteners 36.

Extending between ends 22*a* and 22*b* of base member 22 are elongated slotted tracks 40 and 42. Tracks 40 and 42 are supported by brackets 24 and 28.

Figure 2:
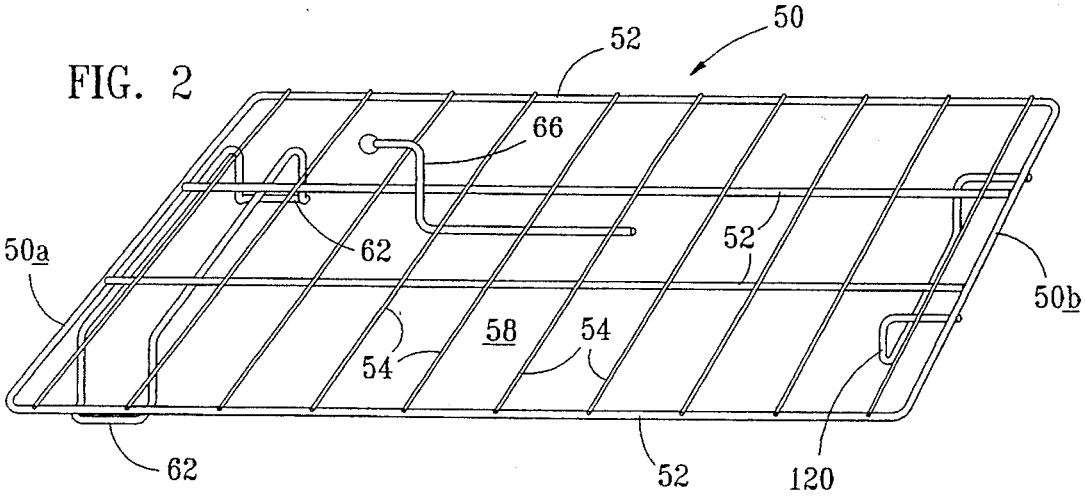
FIG. 2 is a perspective view of the bag supporting rack for use with the base member of the present invention shown in FIG. 1.

Referring specifically to FIG. 2, the present rack 20 includes a tray or rack 50 adapted for supporting a supply of bags. Rack 50 has a first end 50*a* and a second end 50*b*. Rack 50 includes multiple horizontal support members 52 and vertical support members 54 to create a supporting surface 58 for a supply of bags.

Figure 3:
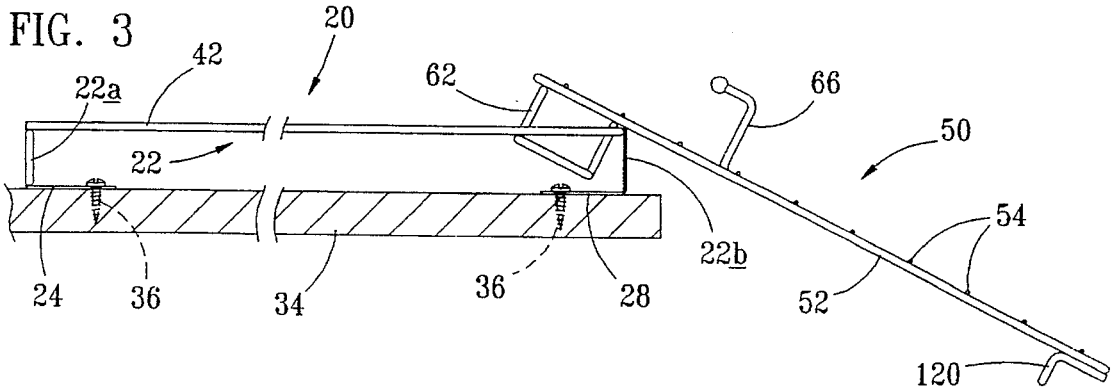
FIG. 3 is a side elevational view of the present rack in the bag loading position.
Figure 4:
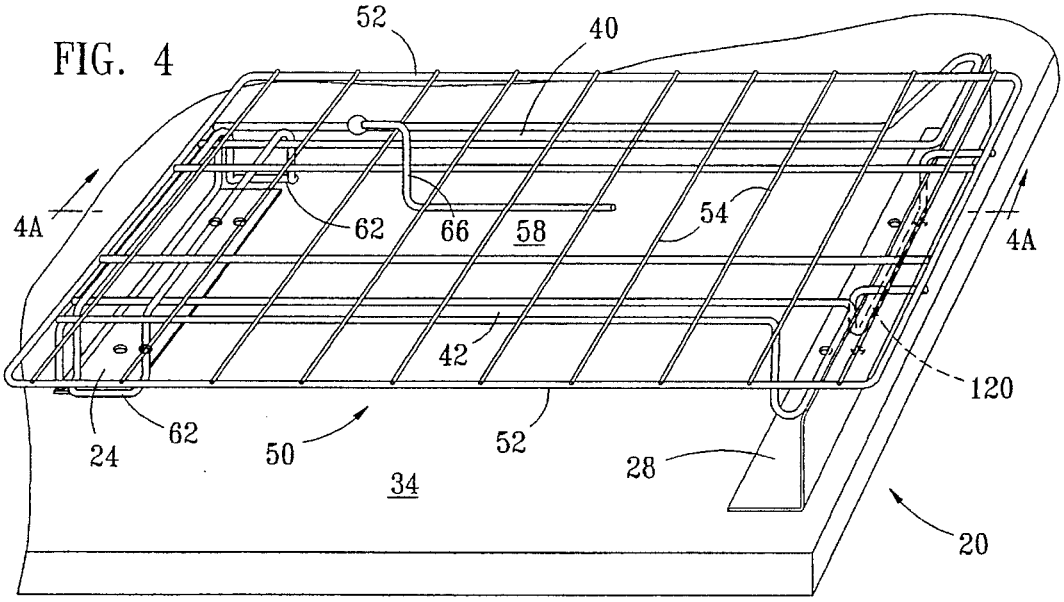
FIG. 4 is a perspective view of the present rack in the bag storing and dispensing position.
Figure 4A:
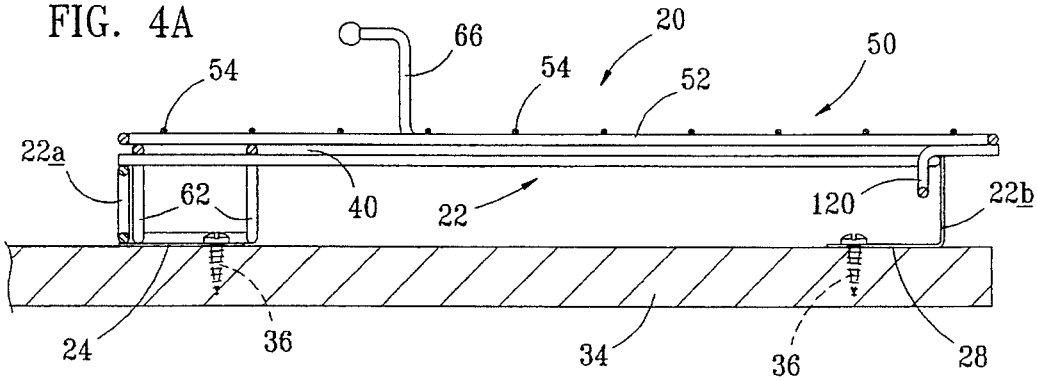
FIG. 4A is a sectional view taken generally along sectional lines 4A—4A of FIG. 4.

Extending below surface 58 of rack 50, and adjacent to end 50*a*, are projections 62 which are disposed substantially perpendicular to surface 58. Projections 62 engage slots 40 and 42 of base member 22 and allow rack 50 to slide on base member 22 from a bag loading position as illustrated in FIG. 3 wherein end 50*a* of rack 50 lies adjacent to end 22*b* of base member 22, and a bag storing and dispensing position as illustrated in FIGS. 4 and 4A, in which end 50*a* of rack 50 lies adjacent to end 22*a* of base member 22. Rack 50 is disposed at an angular position as illustrated in FIG. 3, and extends beyond shelf 34 to allow rack 50 to be positioned to receive a supply of bags. Once loaded, rack 50 is slid on base member 22 under the counter and parallel to shelf 34. Check-out or cashier personnel, in order to dispense a bag from rack 20, merely reach under the counter to remove a bag from rack 20.

Figure 5:
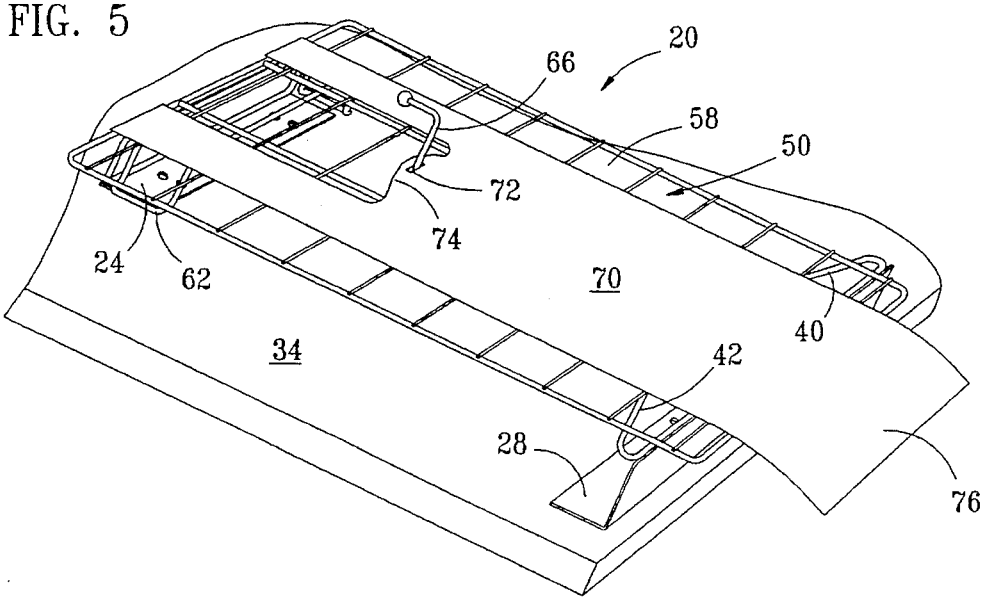
FIG. 5 is a perspective view of the present rack supporting a supply of T-shirt type bags.

A supply of bags is mounted to rack 50 utilizing a post 66 which projects upwardly from surface 58 of rack 50 in order to receive a supply of bags. As illustrated in FIG. 5, a supply of bags 70 of a T-shirt style are supported on rack 50 by a post 66 through an aperture 72 contained within the mouth area 74 of bags 70. By grasping the lower portion 76 of bags 70, the area of mouth 74 is severed to allow bags 70 to be removed from post 66.

Figure 6:
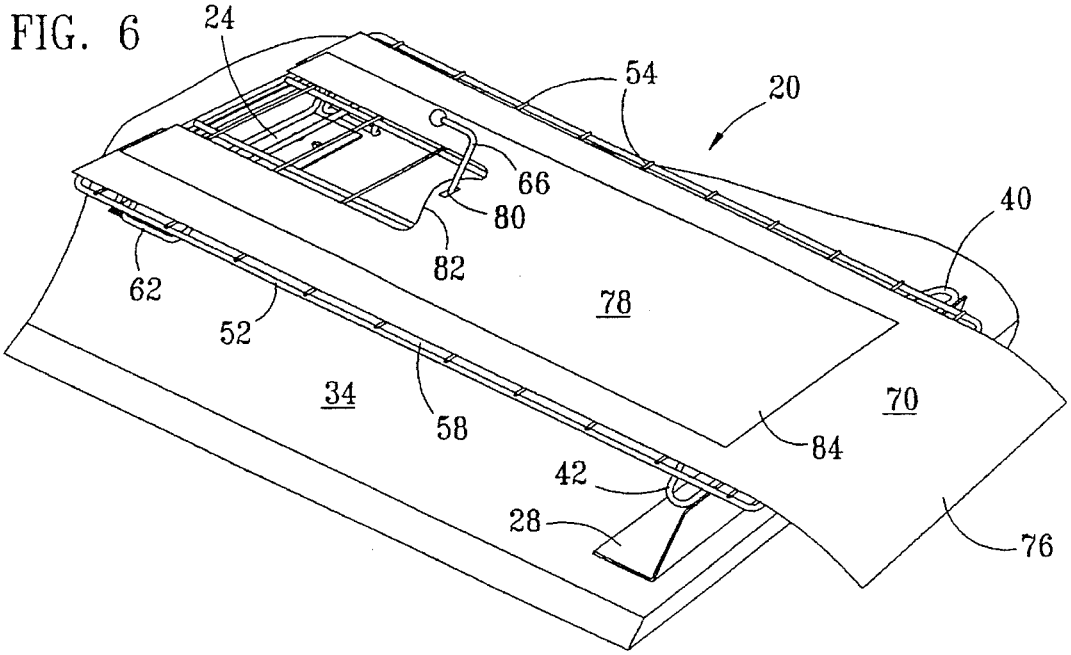
FIG. 6 is a perspective view of the present rack supporting a supply of multiple-sized T-shirt type bags.

FIG. 6 illustrates the use of the present rack 20 for storing and dispensing multiple sized. T-shirt style bags. Smaller sized bags 78 are disposed on post 66 on top of the supply of bags 70. The supply of bags 78 are supported on post 66 through an aperture 80 contained within the mouth area 82 of bags 78. Bags 78 are similarly removed from rack 20 by grasping the lower portion 84 of bags 78.

Figure 7:
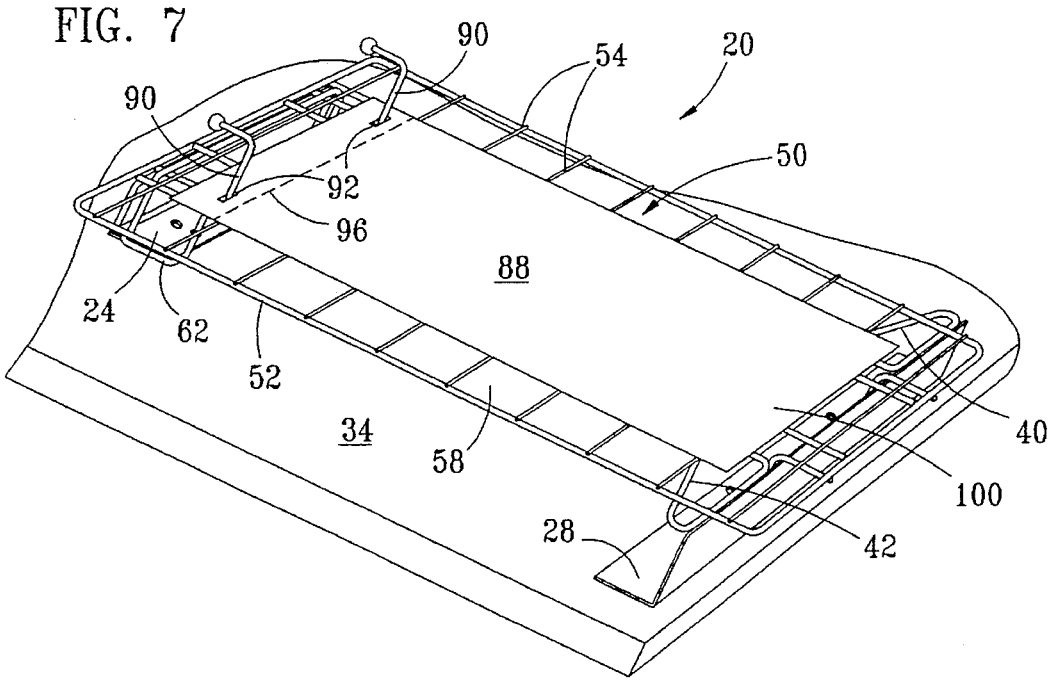
FIG. 7 is a perspective view of the present rack supporting a supply of merchandize type bags.

FIG. 7 illustrates the use of rack 20 for supporting a supply of merchandise type bags. Rack 20 includes two posts 90 extending substantially perpendicular to surface 58 of rack 50. Merchandise bags 88 contain apertures 92 through which merchandise bags 88 are supported. Apertures 92 may be disposed in a header section 94. Bags 88 are removed from the header section 94 along a perforation line 96 by grasping the lower portion 100 of bags 88.

Referring again to FIG. 2, in order to retain rack 50 in base member 22 in the bag storing and dispensing position, rack 22 is provided with a projection 120 extending substantially perpendicular to surface 58 of rack 50. Projection 120 engages end 22*b* of base member 22 in order to provide a stop to prevent rack 50 from sliding outwardly from base member 22 when bags are dispensed from rack 20. In order to remove rack 50 from the position illustrated in FIG. 4 to the position illustrated in FIG. 3, rack 50 must be lifted upwardly so that projection 120 rises above end 22*b* of base member 22 to enable rack 50 to extend from end 22*b* of base member 22 for bag loading purposes.

Figure 8:
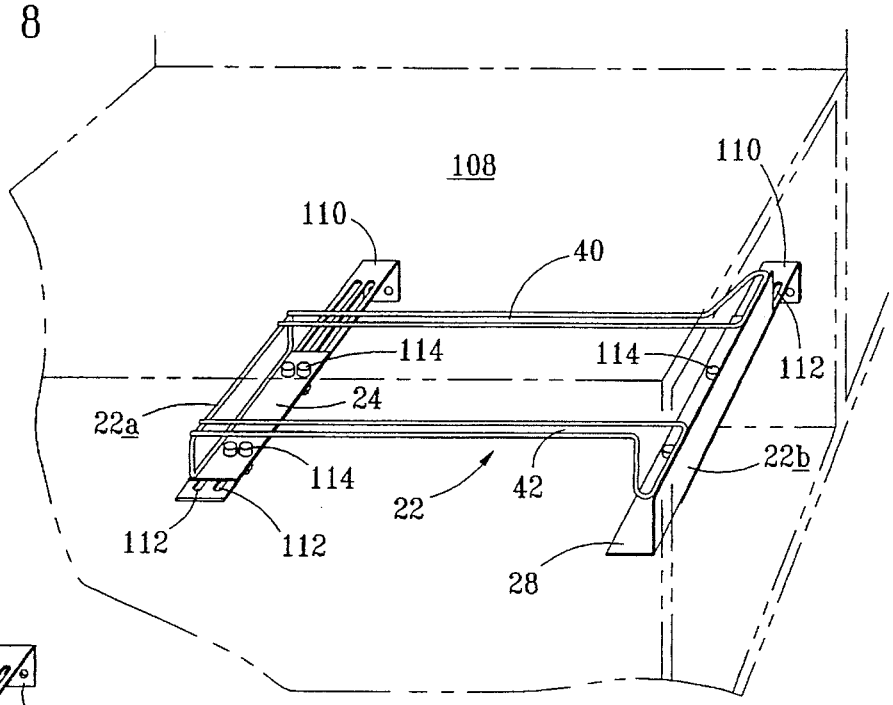
FIG. 8 is a perspective view of the present base member adapted to be mounted to a vertical member.
Figure 8A:
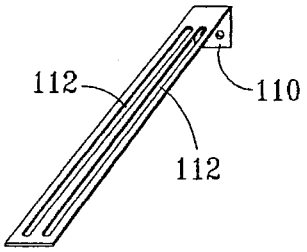
FIG. 8A is a perspective view of a bracket shown in FIG. 8.

FIGS. 1–7 illustrate the use of the present rack 20 being horizontally mounted on a shelf 34. Where no shelf or horizontal support surface is available, rack 20 can be mounted from a vertical support surface or wall 108 of a counter as illustrated in FIG. 8. Base member 22 is supported on a pair of brackets 110, more clearly illustrated in FIG. 8A. Brackets 110 include slotted apertures 112 which receive fasteners 114 mounted within apertures 26 of ends 22*a* and 22*b* of base member 22. Ends 22*a* and 22*b* of base member 22 are positioned with respect to wall 108 utilizing slots 112 of brackets 110.

Figure 9:
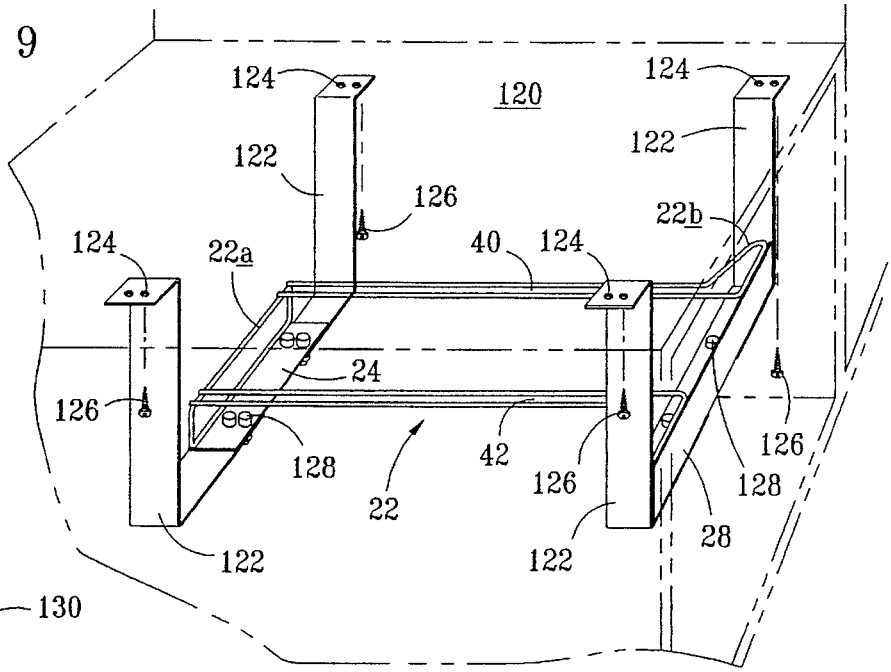
FIG. 9 is a perspective view of the present base member adapted to be suspended from a horizontal member.
Figure 9A:
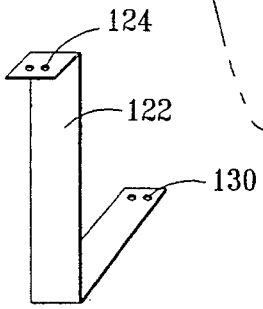
FIG. 9A is a perspective view of a bracket shown in FIG. 9.
Figure 10:
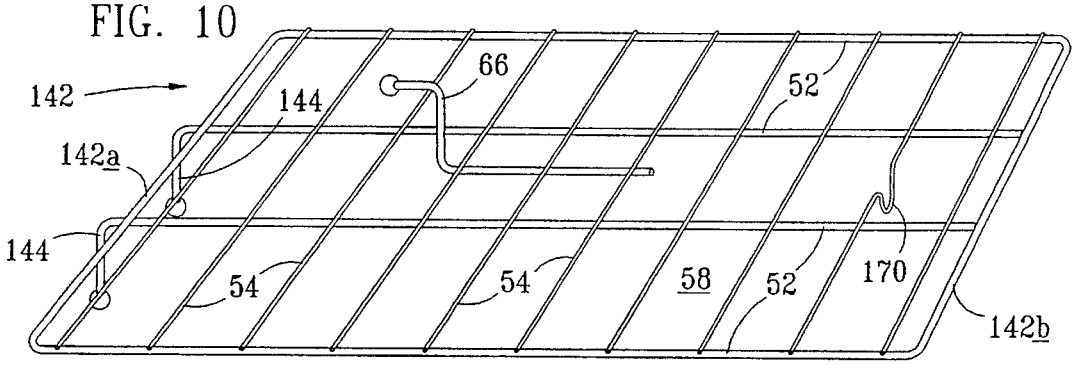
FIG. 10 is a perspective view of an additional embodiment of the present rack.

FIG. 9 illustrates a further mounting technique for mounting base member 22. FIG. 9 illustrates base member 22 being suspended from a horizontal surface 120 utilizing brackets 122 which are more clearly illustrated in FIG. 9A. Brackets 122 include apertures 124 for receiving fasteners 126 for mounting to surface 120. Ends 22*a* and 22*b* of base member 22 are mounted to brackets 122 utilizing fasteners 128 which are received in apertures 130 of brackets 122. Rack 20 operates in a manner identical to that described with respect to FIGS. 1–7 for the mounting arrangements illustrated in FIGS. 8 and 9.

Referring now simultaneously to FIGS. 10–13, an additional embodiment of the present rack is illustrated, and is generally identified by the numeral 140. Like numerals are utilized for like and corresponding components previously identified with respect to FIGS. 1–9. Rack 140 includes a rack 142. Rack 142 includes projections 144 extending below surface 58 of rack 142 and extending substantially perpendicular to horizontal members 52.

Figure 11:
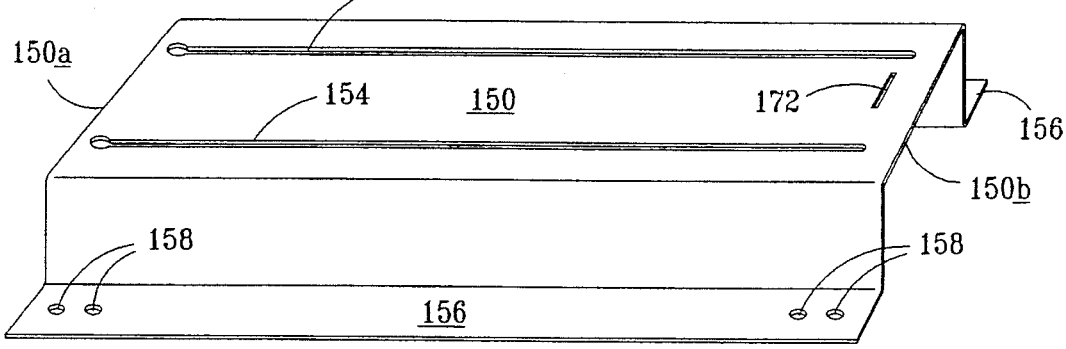
FIG. 11 is a perspective view of an additional embodiment of the present base member for use with the rack shown in FIG. 10.

Referring more particularly to FIG. 11, rack 140 includes a base member 150 having elongated slots 152 and 154 extending between ends 150*a* and 150*b*. Base member 150 includes flanges 156 having apertures 158 for mounting base member 150 to a horizontal support surface 160 utilizing fasteners 162 shown in FIG. 13.

Figure 12:
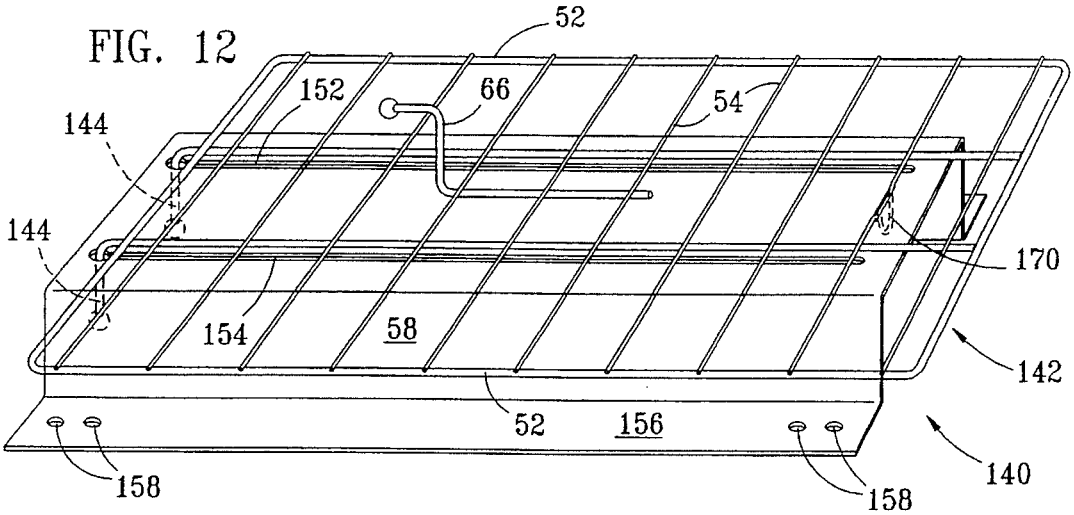
FIG. 12 is a perspective view of the present rack shown in FIG. 10 in the bag storing and dispensing position.
Figure 13:
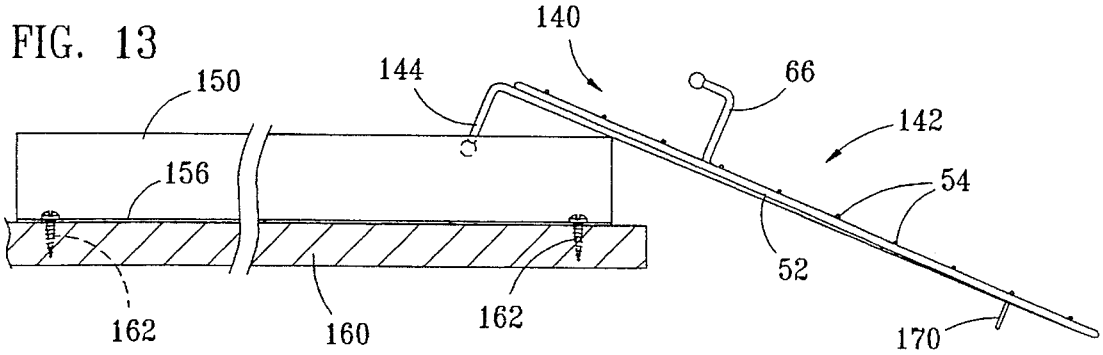
FIG. 13 is a side elevational view of the rack shown in FIGS. 10 and 11 in the bag loading position.

As illustrated in FIG. 12, projections 144 are selectively insertable into slots 152 and 154 to enable rack 142 to slide between ends 150*a* and 150*b* of base member 150. FIG. 12 illustrates rack 142 in the bag storing and dispensing position. FIG. 13 illustrates rack 140 in the bag loading position wherein rack 142 is disposed outwardly from base member 150 and support surface 160 in order to expose rack 142 from underneath the counter to load a supply of bags on post 66. Bags are removed from rack 140 in a manner similar to that previously described with respect to rack 20.

Rack 142 includes a projection 170 disposed adjacent to end 142*b* of rack 142. Projection 170 aligns with an aperture 172 within base member 150 to provide a stop in order to prevent rack 142 from sliding outwardly of base member 150 when bags are being dispensed from rack 140. In order to move rack 142 from the position illustrated in FIG. 12 to the position illustrated in FIG. 13, rack 142 must be lifted upwardly such that projection 170 is removed from aperture 172.

It therefore can be seen that the present invention provides for a rack for storing and dispensing a supply of bags wherein the rack is mounted below the surface of a counter to provide for the storing and dispensing of bags in a convenient location without requiring space on the top surface of a cashier check-out counter.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A rack for storing and dispensing a supply of bags, each bag of the supply having an open top and a closed bottom, the rack comprising:

a base member having first and second ends;

said base member including a track extending between said first and second ends thereof;

a rack having first and second ends and a surface adapted for supporting a supply of bags; and said rack including means for engaging said track, said rack being slidable on said base member between a bag loading position in which said rack first end is disposed adjacent said base member second end, and a bag storing and dispensing position in which said rack first end is disposed adjacent said base member first end.

2. The rack of claim 1 wherein said base member track includes a pair of elongated slotted apertures extending between said first and second ends of said base member.

3. The rack of claim 2 wherein said means for engaging said track extends from said surface of said rack for engaging said pair of elongated slotted apertures.

4. The rack of claim 1 and further including:

means extending from said surface of said rack for engaging said base member for locking said rack to said base member in said bag storing and dispensing position.

5. The rack of claim 1 and further including:

means extending from said surface of said rack for receiving a supply of bags.

6. The rack of claim 5 wherein said means extending from said surface of said rack for receiving a supply of bags includes:

a post centrally disposed on said rack for engaging a supply of bags adjacent to the open top of the bags, such that the closed bottom of the bags lies adjacent said rack second end.

7. The rack of claim 5 wherein said means extending from said surface of said rack for receiving a supply of bags includes:

first and second posts disposed adjacent said rack first end for engaging a supply of bags adjacent the open top of the bags, such that the closed bottom of the bags lie adjacent said rack second end.

8. A rack for storing and dispensing a supply of bags, each bag of the supply of bags having an open top and closed bottom, the rack comprising:

a base member having first and second ends and being adapted to be mounted to a horizontal surface;

said base member including an elongated slotted aperture extending between said first and second ends thereof;

a rack having first and second ends, and a surface adapted for supporting a supply of bags;

means extending from said surface of said rack for slidably engaging said base member aperture, such that said rack is movable between a bag loading position in which said rack first end is disposed adjacent said base member second end and said rack is angularly disposed with respect to said base member, and a bag storing and dispensing position in which said rack first end is disposed adjacent to said base member first end and said rack is disposed parallel to said base member; and means extending from said surface of said rack for receiving a supply of bags.

9. The rack of claim 8 wherein said base member includes a pair of elongated slotted apertures.

10. The rack of claim 8 wherein said means extending from said surface of said rack for receiving the supply of bags includes a post centrally disposed on said rack for engaging a supply of bags adjacent the open top of the bags, such that the closed bottom of the supply of bags lie adjacent said rack second end.

11. The rack of claim 8 wherein said means extending from said surface of said rack for receiving the supply of bags includes:

first and second posts disposed adjacent said rack first end for engaging a supply of bags adjacent the open top of the bags, such that the closed bottom of the supply of bags lie adjacent said rack second end.

12. The rack of claim 8 wherein said rack is adapted for supporting a supply of bags of different sizes.

13. The rack of claim 8 wherein said rack includes means extending from said surface of said rack for engaging said base member for selectively locking said rack to said base member in said bag storing and dispensing position.

14. A rack for storing and dispensing a supply of bags, each bag of the supply of bags having an open top and a closed bottom, the rack comprising:

a base member having first and second ends and being adapted to be mounted to a horizontal surface;

said base member including first and second elongated slotted apertures extending between said first and second ends thereof;

a rack having first and second ends and a surface adapted for supporting a supply of bags;

means extending generally perpendicular to and below said surface of said rack for slidably engaging said first and second base member apertures, such that said rack is movable between a bag loading position in which said rack first end is disposed adjacent said base member second end and said rack is angularly disposed with respect to said base member, and a bag storing and dispensing position in which said rack first end is disposed adjacent to said base member first end and said rack is disposed parallel to said base member;

means extending generally perpendicular from said surface of said rack for engaging said base member for selectively locking said rack to said base member in said bag storing and dispensing position; and means extending generally perpendicular from said surface of said rack for receiving a supply of bags.

15. The rack of claim 14 wherein said means extending from said surface of said rack for receiving a supply of bags includes:

a post centrally disposed on said rack for engaging a supply of bags adjacent the open top of the bags, such that the closed bottom of the bags lie adjacent said rack second end.

16. The rack of claim 14 wherein said means extending from said surface of said rack for receiving a supply of bags includes:

first and second posts disposed adjacent said rack first end for engaging the supply of bags adjacent the open top of the supply of bags, such that the closed bottom of the supply of bags lie adjacent said rack second end.

17. The rack of claim 14 wherein said rack is adapted for supporting a supply of bags of different sizes.

* * * * *